United States Patent [19]

Kerek

[11] Patent Number: 4,867,692

[45] Date of Patent: Sep. 19, 1989

[54] ELECTRICAL CONNECTOR HIGH CURRENT SURGE PROTECTION

[75] Inventor: Leslie L. Kerek, Irvine, Calif.

[73] Assignee: Interconnection Products, Inc., Santa Ana, Calif.

[21] Appl. No.: 124,738

[22] Filed: Nov. 24, 1987

[51] Int. Cl.[4] ..... H01R 4/66

[52] U.S. Cl. ..... 439/101; 439/607

[58] Field of Search ..... 439/92, 101, 108, 607

[56] References Cited

U.S. PATENT DOCUMENTS

| | | | |
|---|---|---|---|
| 3,046,512 | 7/1962 | Remke . | |
| 3,329,925 | 7/1965 | Johnson . | |
| 3,521,222 | 11/1967 | Andrews . | |
| 4,260,966 | 4/1981 | Boutros . | |
| 4,382,653 | 5/1983 | Blanchard . | |
| 4,458,220 | 7/1984 | Carter . | |
| 4,486,059 | 12/1984 | Deyoung | 439/92 |
| 4,518,209 | 5/1985 | Negley | 439/92 |
| 4,579,415 | 4/1986 | van Brunt . | |
| 4,598,969 | 1/1986 | Stephenson . | |
| 4,655,518 | 4/1987 | Johnson et al. | 439/108 |

*Primary Examiner*—Joseph H. McGlynn

*Attorney, Agent, or Firm*—Watts, Hoffmann, Fisher & Heinke Co.

[57] ABSTRACT

An electrical connector apparatus having a plug and a receptacle is disclosed. The body of each of the plug and receptacle are chiefly made of an low conductivity material, such as composite. Despite the low conductive characteristics of the connector material, the apparatus is provided with capability for safely handling short duration relatively high current electrical surges such as those produced by lightning strikes and EMP. This capability is provided by elongated conductive elements associated respectively with each of the plug and receptacle. The elements each define a respective contact region, which regions mate when the plug is inserted in the receptacle in a predetermined alignment. The opposite ends of the conductive elements are coupled to the outer conductive jackets of adjacent sections of jacketed cable to which each of the plug and receptacle are electrically coupled.

23 Claims, 4 Drawing Sheets

ELECTRICAL CONNECTOR HIGH CURRENT SURGE PROTECTION

DESCRIPTION

1. Technical Field

This invention relates generally to the field of electrical connectors, and more particularly to apparatus and method for providing electrical connectors made of low conductive and/or nonconductive materials, such as composite, with protection against relatively high current electrical surges produced by natural phenomena such as lightning, and various man-made phenomena, such as EMP.

2. Background Art

One form of electrical connector includes a plug portion and a receptacle portion. Each of the plug and receptacle portions includes an insulative insert carrying one or more electrical contacts. When the plug and receptacle are mated, or engaged, the electrical contacts are engaged to complete an electrical circuit.

In a typical connector apparatus of this type, the plug portion comprises a generally barrel-shaped plug body. The receptacle portion comprises a cylindrical receptacle body having an outer wall defined by inside and outside diameters, the inside diameter of the wall defining a receptacle cavity to facilitate the removable insertion and engagement therein of the plug body as generally described above.

Connectors of the type described are frequently used to longitudinally couple together sections of jacketed cable incorporating one or more interior conductors and an outer conductor jacket which is desirably grounded. One of the functions of the grounded outer jacket is to facilitate the harmless grounding of short duration, large current impulses, such as resulting from lightning strikes, which may occur along the cable, or along other HF, VHF or UHF transmission lines. Such surges, if not properly grounded, can damage equipment, such as communication and control equipment, to which the cable is connected.

Another source of high current short duration potentially desctructive surges, more particularly associated with military applications, is the so-called EMP or "Electro-magnetic Pulse" which is caused by a nuclear explosion. Communication and other sensitive equipment present within the region influenced by the EMP is highly vulnerable to damage or destruction unless EMP can be effectively grounded. In military applications, therefore, such as in warships and warplanes, as well as in ground installations, the ability to obviate the adverse effects of EMP is vital.

Vulnerability of sensitive electronic gear to both natural and man made surge phenomena has been exacerbated in recent years by the increasing use of composite, plastic and other low conductive materials for structural components in such military hardware as helicopters, war planes, ground transport equipment and other items. The increased use of structural materials having either low electrical conductivity, or virtually none, makes it more difficult to effectively ground electrical surges caused by whatever source.

In facilitating provision for grounding of high current short duration electrical surges, it is desirable that the outer jackets of adjacent longitudinally coupled sections of cable be electrically conductively coupled together. Such electrical coupling of sections along the entire transmission line path facilitates the provision of adequate grounding means by the use of a single grounding terminal, or by a relatively few such terminals. If the jackets are not electrically conductively coupled together, then each section of jacketing would require its own ground, increasing the cost and complexity of the equipment.

Connector parts, such as plugs and receptacles, have been made from many different materials. For example, metallic connector part bodies have been used. These possess the inherent advantage of electrical conductivity rendering the electrical coupling of jacketing of adjacent sections of cable an easy matter. Because of the tendency of metallic parts to corrode, however, use of such parts is not feasible in corrosive environments, or such use makes necessary the addition of expensive and wear sensitive corrosion-inhibiting plating.

More recently, the corrosion and weight problem has been dealt with by the use of composite or plastic materials for plug and receptacle connector body parts. Such parts possess mechanical strength and wear resistance which is often quite satisfactory, and are not subject to corrosion, but lack the inherent advantages of good electrical conductivity associated with metal parts.

In order to add or improve the facility for electrical conductivity of such composite or plastic parts, resort has been had to providing such parts with electrically conductive metallic plating. While such plating can be helpful in facilitating the conduction of high frequency low current electromagnetic signals, the plating is often too thin to afford the current carrying capacity necessary for safe conduction of the higher current surges described above. Additionally, the metallic plating is often subject to corrosion, and to damage or removal, over time, by mechanical wear or abrasion. Additionally, use of such plating adds to the material and assembly cost of connector parts, particularly where relatively inert plating materials, such as gold or silver, are used.

It is an object of this invention to provide electrical connector parts which are inherently resistant to corrosion, yet have the capability for conduction of relatively high current short duration electrical surges or pulses between longitudinally coupled jacket sections of cable which are connected by use of the connector parts.

DISCLOSURE OF THE INVENTION

The disadvantages of the prior art are reduced or eliminated by use of an electrical conductor apparatus including a plug barrel member and a receptacle member. The plug barrel defines an outer wall. The receptacle has an external wall portion which defines a receptacle cavity suitable for accommodating engagement of the plug barrel member. The receptacle wall is defined by outward and inward facing surfaces. Each of the plug barrel and receptacle is chiefly made of a low electrically conductive or insulative material. Current carrying capacity is provided to the members by first and second conductive elements of material extending generally longitudinally with respect to the plug and receptacle parts. Each conductive element terminates in a contact region which mates in a wiping contact action with the contact region of the other element when the plug and receptacle are engaged. The conductive elements are connected at their remote ends to the outer jacket portion of respective adjacent sections of cable, providing good conductive coupling between the jacket portions of the cable to facilitate efficient grounding of high current electrical surges which may occur due to undesirable phenomena.

In accordance with a specific embodiment, each conductive element is made of a strip of metallic conductive material, such as copper alloy, gold or silver, having a cross sectional dimension sufficient to provide low enough resistance for the efficient handling of relatively high current short duration electrical surges.

More specifically, a resistance of about 2.0 milliohms or less is desirable.

In accordance with another specific aspect, the contact regions define a curved configuration, each extending in convex fashion toward the other to define a resilient coupling action when the receptacle and plug are engaged. Such resilient coupling results in a desirable wiping action during establishment of contact. It also inhibits inadvertent loss of contact as a result of shock or vibration.

The present invention will be understood in greater detail by reference to the following detailed description, and to the drawings.

BEST MODE FOR CARRYING OUT INVENTION

Figure 1:
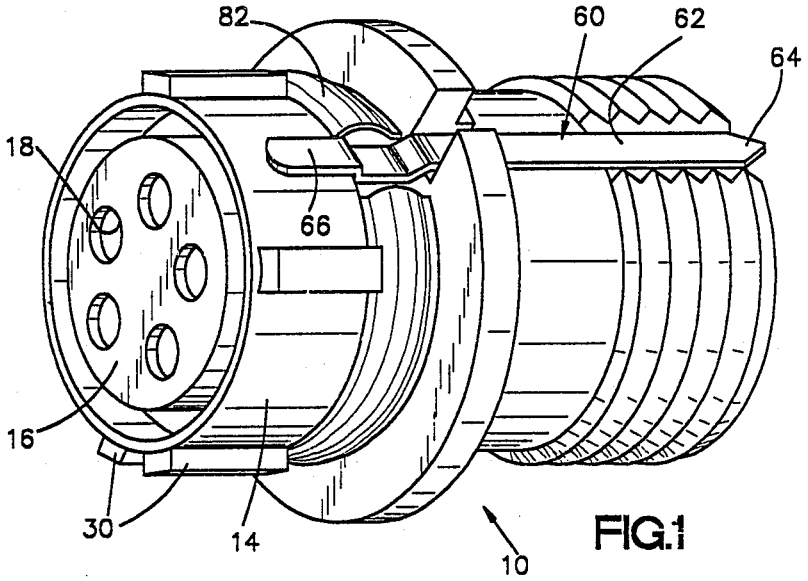
FIG.1 is an isometric view, partially broken away, illustrating a plug portion of an electrical connector in accordance with the present invention.
Figure 2:
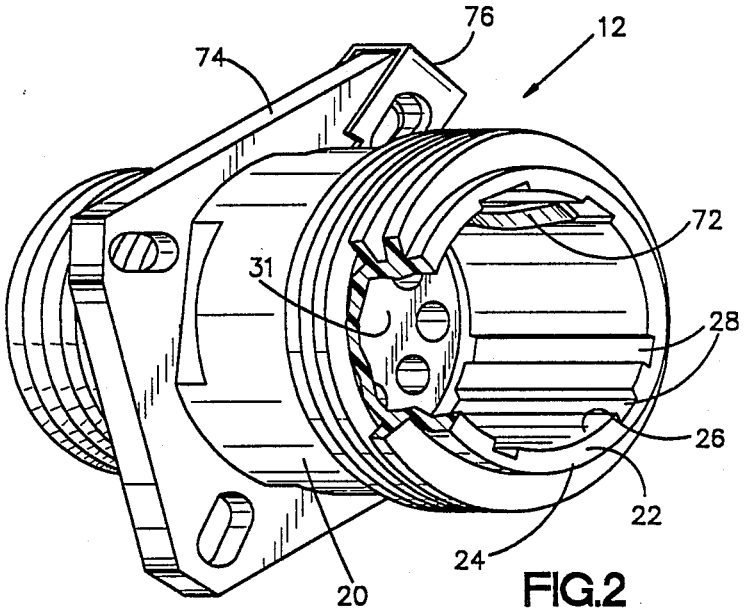
FIG. 2 is an isometric view illustrating a receptacle portion of an electrical connector in accordance with the present invention.
Figure 3:
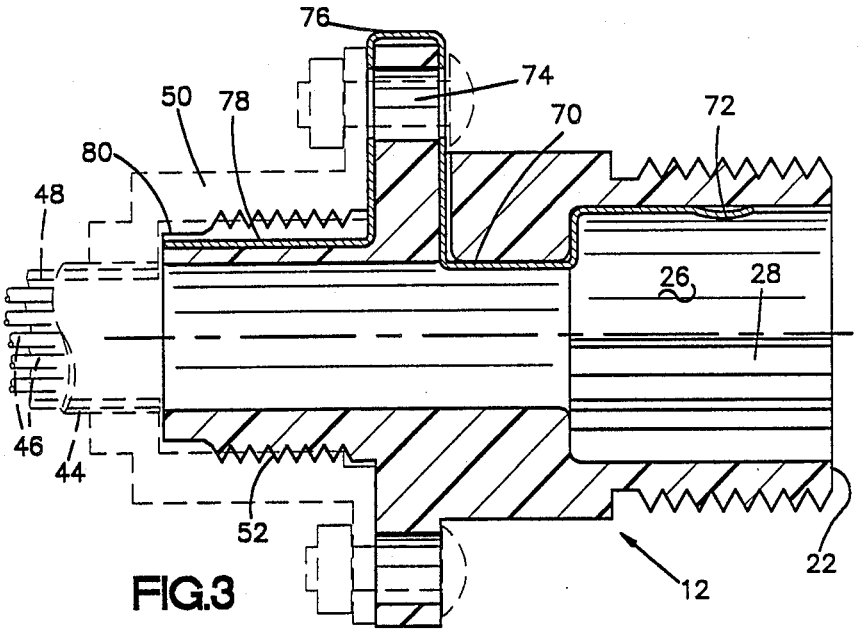
FIG. 3 is an elevational view, taken in cross section, illustrating the embodiment of FIG. 2.

The drawings illustrate various views of an electrical connector apparatus including a plug barrel 10 (FIGS. 1, 4) and a receptacle portion 12 (FIGS. 2, 3). As shown in the drawings, the plug barrel comprises a generally cylindrical plug body portion 14 which is made of a composite material having relatively low electrical conductivity. Inserted in the plug body 14 is an insulative member 16 which defines the location of, and supports, electrical contacts such as at 18.

The receptacle 12 includes a receptacle body portion 20 made of a composite material similar to that used for the plug body portion 14. The receptacle body 20 defines a generally hollow cylindrical configuration defined by a wall 22 having an outward facing surface 24 and an inward facing surface 26.

The plug and receptacle body portions can be made of substantially insulative plastic material as well as composite materials. By "composite" is meant a substance including a binder or adhesive material, such as epoxy, impregnated with fibers. The fibers can be of either nonconductive or conductive materials. Where conductive fibers are used, the composite material, while not having good electrical conductivity, possesses electrical conductivity at a low level. This low level of electrical conductivity can be useful for shielding effects, but is not sufficient to handle high current surges such as are discussed in this document. Examples of conductive composites are those comprising mixtures of binder material and aluminum flakes, stainless steel, or carbon. Mixtures of nickel coated carbon fibers are also useful.

Though the plug and receptacle are depicted in the drawings as having circular cross-section, the parts are not so limited in design and can have other cross-sectional geometry such as rectangular, oval, etc.

Keyways such as 28 are defined on the inward facing surface 26 of the wall 22 for matching alignment by keys such as 30 (FIG. 1) on the plug barrel.

Another insulative contact mounting structure 31, of known type is located within the cavity defined by the inward facing surface 26 of the receptacle wall 22. This insulative structure defines the location of and supports electrical contacts which are aligned for mating engagement with the contacts such as 18 supported by the insulative structure 16 in the plug barrel when the plug barrel is inserted into the receptacle such that the keys 30 are aligned with the respective keyways 28 on the receptacle.

Figure 4:
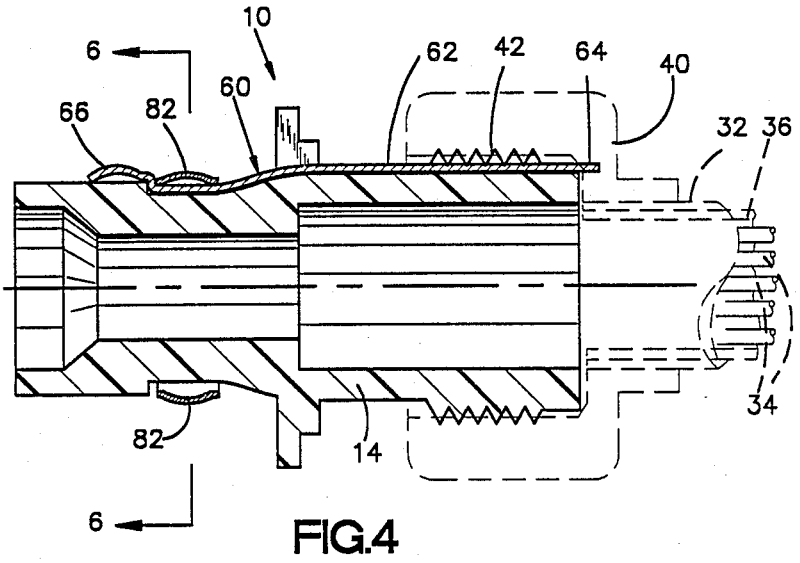
FIG. 4 is an elevational view, taken in cross section of the embodiment of FIG. 1.

Referring to FIG. 4, the electrical contacts 18 are conductively coupled in known fashion through the plug barrel to a section of jacketed cable, shown in phantom at 32, extending to the right of the plug barrel as illustrated in FIG. 4. The jacketed cable includes one or more interior conductors such as 34 and an outer conductive jacket 36.

Also illustrated in FIG. 4, in phantom, is a known coupling device 40 for securing the cable to the right hand end of the plug barrel by means of a threaded portion 42.

Referring to FIG. 3, another section of jacketed cable 44, shown in phantom, including one or more central or interior conductors such as 46 and an outer conductive jacket 48, is secured to the left hand end of the receptacle, as shown in FIG. 3, by means of a known coupling device 50, also shown in phantom. The interior conductors of the cable 44 are electrically coupled to electrical contacts in the receptacle cavity in a position at which, when plug and receptacle are engaged, the interior conductors of the cable section 32 are electrically coupled to the interior conductors of the cable section 44.

The coupling member 50 secures the cable 44 to the left hand end of the receptacle as shown in FIG. 3 by means of a threaded portion 52 defined on the outer surface of the receptacle.

It is important to realize that the composite material from which body portions of the plug barrel and the receptacle are made has little or no inherent capability of electrical conduction. Consequently, special provision, described in more detail below, must be made to electrically couple together the outer jacket portions 48, 36 of the respective adjacently coupled sections of cable 44, 32. This conductive coupling extends between the jacket portions of adjacent sections of cable to facilitate grounding of the outer jacket portions. Moreover, the conductive coupling should be capable of handling short duration, but relatively high current electrical surges which may arise along the cable as a result of phenomena such as lightning strikes or EMP.

An important feature of this invention is the provision of this means for effecting this electrical coupling between jacket portions of cable secured to the plug barrel and to the receptacle, respectively.

Figure 9:
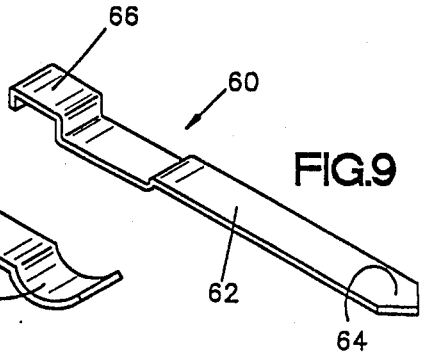
FIG. 9 is an isometric illustration of a feature of the embodiment shown in FIG. 2; p

Referring to FIG. 1, this conductive means is embodied in part by a first conductive element 60 extending generally longitudinally with respect to the plug barrel. The conductive portion 60 includes a tongue portion generally indicated at 62, near the right hand end of the plug barrel as shown in FIG. 1, and which terminates in an end section 64. The end section 64 is conductively coupled in known fashion to the outer jacket portion 36 of the cable section 32. The left hand end of the conductive element 60, as shown in FIG. 1, terminates in a portion 66 which defines a first contact region. See also FIG. 9. The first contact region 66 is adapted to engage a second conductive element attached to the receptacle portion, which part will be described in more detail below.

Figure 8:
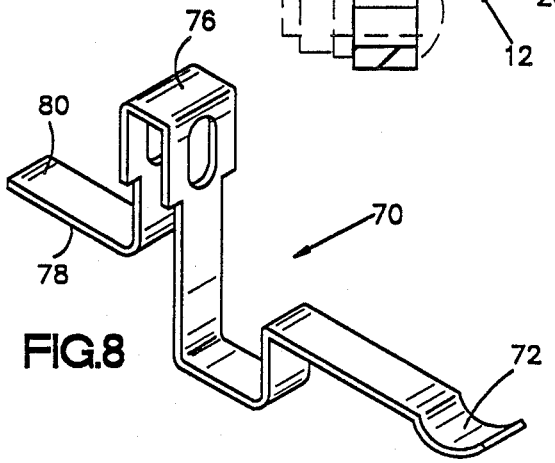
FIG. 8 is an isometric illustration of a detail of the embodiment of FIG. 1.

A second conductive element 70, attached to the receptacle, is illustrated in FIGS. 2 and 3, and is shown in detail in FIG. 8. Near the right hand end of the element 70, as shown in FIG. 3, the element terminates in a portion defining a contact region 72. It can also be seen from the cross sectional view of FIG. 3 that the element 70, although disposed generally on the inward facing surface of the receptacle wall 22, becomes, as it progresses to the left in FIG. 3, recessed, or buried, within the composite material making up the receptacle.

In the embodiment shown in FIG. 3 and in FIG. 2, the receptacle includes a flange portion 74. The conductive element 70 may emerge from the composite material and, in a section designated generally as 76, defines a conductive path around the outer edge of the flange 74. On the opposite side of the flange 74, i.e., to the left as shown in FIG. 3, the element 70, over a section 78, again becomes recessed within the composite material making up the receptacle, until terminating in exposed region 80, which is suitable for electrically conductive coupling to the jacket portion of the cable 44.

An advantage of the conductive element running about the outside of the receptacle, such as around the flange as discussed above, is that the exposed nature of the conductive element facilitates grounding of the conductive element and hence of the jacket portions of the jacketed cables.

It is significant, however, to realize that, where a large number of grounding points is not considered vital, the conductive element such as 60 or 70 can be substantially embedded in the material from which the body of the receptacle or plug barrel is made. In fact, manufacturing costs are minimized where substantially the entire elongated conductive element is embedded or buried in the body part material, leaving only small contact points exposed at either end.

Figure 5:
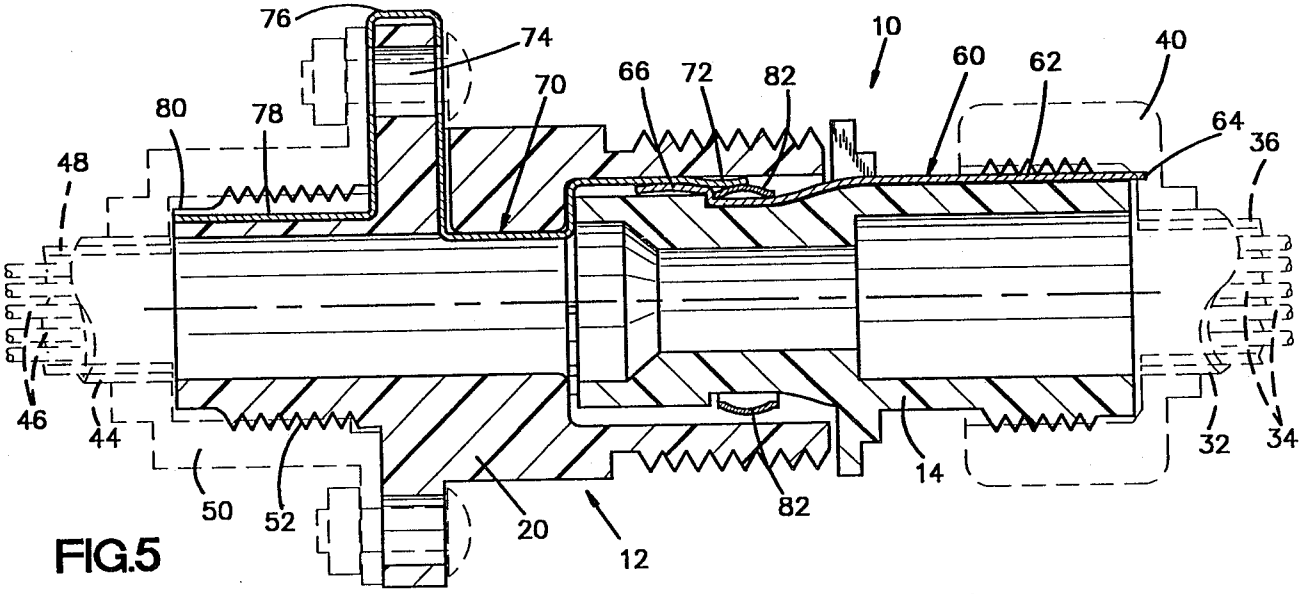
FIG. 5 is a cross sectional elevational view illustrating the operative engagement of the portions of FIGS. 1 and 2.

FIG. 5 illustrates a plug and receptacle, with their associated conductive elements 60, 70, in mated, or engaged, relation. It will be observed that the respective contact regions 66, 72, are configured with a curvature which, when the elements 60, 70 are engaged, extends the contact regions toward one another, to provide resilient pressure tending to keep the contact areas in electrically conductive contact. Such resilient pressure provides a desirable wiping action which, during engagement and disengagement, tends to beneficially affect the contact areas by wiping away oxides and other contaminants which might otherwise tend to interfere with good electrically conductive contact. The resilient contact pressure also helps to prevent inadvertent decoupling in the presence of vibration.

In the preferred embodiment, the elements 60, 70 are made of electrically conductive metallic strip material. More specifically, the material is BeCu 25 alloy.

The elongated conductive elements 60, 70, are made of a material and have a cross sectional size and length such that their total resistance is about 2.0 milliohms or less. The cross sectional geometry and area can be adjusted in accordance with the length of the conductive element and the material from which it is made in order to implement the desired total resistance.

The elongated conductive elements 60, 70, can, if desired, be plated with another material. That material is chosen to have good electrical conductivity, adequate mechanical properties for the particular application intended, and good corrosion resistance. A material suited for many plating applications is nickel.

In a preferred embodiment, a portion of the second conductive element 70 can be laid longitudinally in one of the keyways 28 in the receptacle cavity. If desired, the keyway accommodating the conductive element can be made somewhat larger than are the other keyways.

By use of the technique of laying the conductive element 70 in a keyway, (keyways being used in many types of receptacle/plug connectors) existing connectors can easily be adapted to enjoy the benefits of the conductive elements of this invention.

Figure 6:
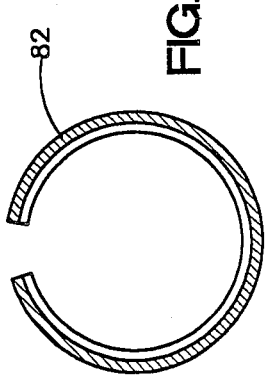
FIG. 6 is a drawing illustrating a detail of the embodiment illustrated in FIG. 2.

Supplemental electrically conductive contact is provided between the element 60, 70 by means of a conductive ring 82, such as shown in detail in FIG. 6. The ring 82 can be also illustrated in cross section in FIG. 5 and in FIG. 4. The ring 82 is made of the same material as the conductive strips 60, 70, and extends over approximately 320°. It will be observed from FIG. 5 that the ring 82 provides supplemental electrical contact between a portion of the conductive strip 60 and the contact region 72 of the conductive strip 70.

Figure 7:
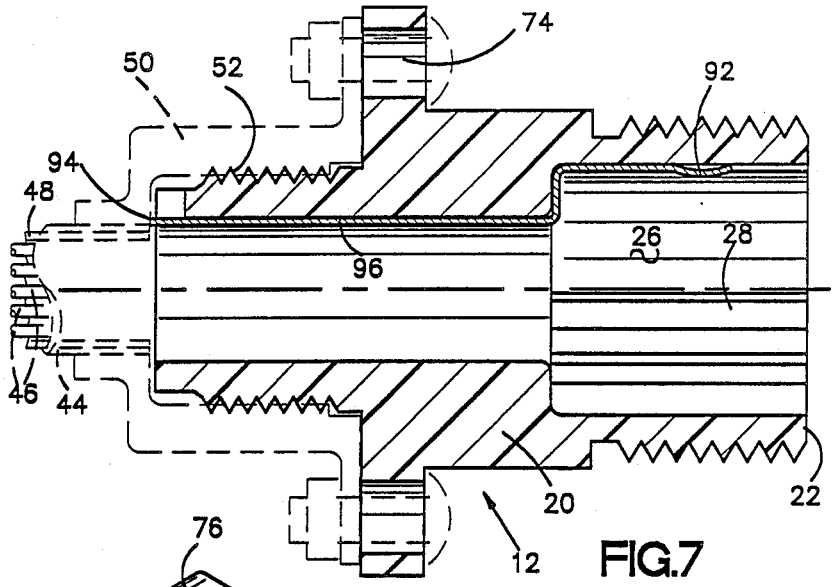
FIG. 7 is an elevational cross sectional view illustrating an alternate embodiment of the structure of FIG. 1.
Figure 10:
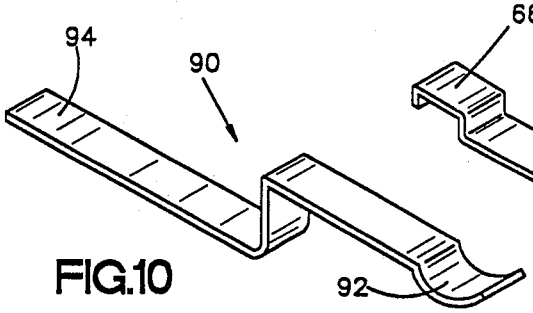
FIG. 10 is an isometric drawing illustrating a detail of the embodiment of FIG. 7.

Another embodiment of a receptacle equipped with a conductive strip is illustrated in FIGS. 7 and 10. FIG. 7, for example, shows a conductive strip 90 having a contact region 92 located on the inward facing surface of the receptacle cavity. As the strip proceeds to the left as shown in FIG. 7, leaving the receptacle cavity, it becomes buried within the composite material making up the receptacle. In this embodiment, the strip does not emerge to traverse around the flange 74, as was the case in the FIGS. 2 and 3 embodiment. Rather, the strip 90 proceeds, recessed within composite material, until it reaches a region 94, near the left hand portion of FIG. 7, at which it can conveniently be coupled electrically to the jacket of the adjacent cable.

For purposes of clarity and simplicity, the foregoing detailed description has described an embodiment of the present invention having only one elongated conductive element on each of the plug and receptacle It is to be understood, however, that those of skill in the art could easily provide multiple conductor element structures about the circumferences of the receptacle cavity and plug barrel, adapted for mutual alignment and registration with one another, to enhance the current carrying capacity of embodiments of this invention.

It is to be understood that the disclosure set forth herein is intended as illustrative, rather than exhaustive, of the invention. Those of ordinary skill in the relevant technical field may be able to make certain additions or modifications to, or deletions from, the specific embodiments described herein, without departing from the spirit or the scope of this invention, as set forth in the appended claims.

I claim:

1. An apparatus for electrically coupling together outer jacket portions of adjacent ends of jacketed electrical cable, said cable including at least one inner conductor and an at least partially electrically conductive outer jacket, said apparatus comprising:

(a) an electrical plug defining an outer wall and made of a material having low electrical conductivity;

(b) a receptacle made of a material having low electrical conductivity, said receptacle having a wall defining inward and outward facing surfaces, said inward facing surface defining a receptacle cavity for accommodating said plug therein;

(c) a first conductive element attached to and extending generally longitudinally with respect to said plug, said first element defining a first contact region exposed facing outwardly from near said outer wall of said plug and having means for facilitating electrically coupling to the outer jacket portion of one of said adjacent ends of jacket electrical cable;

(d) a second conductive element attached to and extending generally longitudinally with respect to said receptacle and defining a second contact region facing inwardly into said cavity, said first and second contact regions being engageable in electrically conductive contact when said plug is engaged in said receptacle with said first contact region and said second contact region being aligned, said second conductive element also including means for facilitating electrical coupling to the outer jacket portion of the other of said adjacent ends of said jacketed cable.

2. The apparatus of claim 1, wherein said first and second conductive elements each comprise electrically conductive metallic material.

3. The apparatus of claim 1, wherein:

each of said first and second elements comprises a strip of metallic electrically conductive material, said strip having a resistance of about 2.0 milliohms or less.

4. The apparatus of claim 1, wherein each of said plug and receptacle comprise composite material.

5. The apparatus of claim 1, wherein at least one of said contact regions is embodied by a curved portion of said element, said curvature extending convex in a direction toward the other of said conductive elements.

6. The apparatus of claim 1, wherein said conductive elements comprise BeCu 25.

7. The apparatus of claim 1, wherein said first conductive element is, for at least a portion of its length, recessed in said low electrically conductive material of said plug.

8. The apparatus of claim 1, wherein said second conductive element is, for at least a portion of its length, recessed in said low electrically conductive material of said receptacle portion.

9. The apparatus of claim 1, wherein:

(a) said receptacle defines a flange extending outwardly from said outward facing wall of said receptacle, and (b) said second conductive element extends through said receptacle wall and around said flange defining an electrically conductive path around said flange.

10. The apparatus of claim 1, further comprising:

(a) at least one key defined on the outer wall of said plug;

(b) at least one keyway defined on said inwardly facing surface of said receptacle, said keyway being sufficiently large to accommodate placement therein of a portion of said second conductive element.

11. The apparatus of claim 1, further comprising:

means for coupling the respective ends of said conductive elements remote from said contact regions to the outer jacket portions of jacketed cable sections.

12. The apparatus of claim 1, wherein:

said conductive elements comprise one electrically conductive metallic material and a plating of another material.

13. The apparatus of claim 12, wherein said plating material comprises an electrically conductive corrosion resistant material.

14. An electrical connector apparatus comprising: p1

(a) a generally cylindrical plug barrel defining an outer circumferential surface;

(b) a generally cylindrical receptacle having an outer circumferential wall defined by inwardly and outwardly facing surfaces, said wall defining a receptacle cavity sized for removable engagement therewithin of said plug barrel;

(c) said plug barrel and said receptacle being chiefly made from a low electrically conductive material;

(d) a first conductive element comprising an elongated piece of metallic electrically conductive material lying near the outer circumferential surface of said plug barrel and extending longitudinally with respect to said plug barrel, said first conductive element defining an exposed first contact region near and facing outwardly from said circumferential surface of said plug barrel, said first conductive element also being adapted for electrical conductive contact to the outer jacket of a jacketed cable section secured to said plug barrel;

(e) a second conductive element made of an electrically conductive metallic material and, extending generally longitudinally with respect to said receptacle, said second conductive element including a second contact region exposed and facing inwardly in said cavity proximate said inwardly facing surface, said second conductive element also being adapted for electrical conductive connection to the jacket portion of another section of jacketed cable;

(f) at least one of said first and second contact regions being configured in a resiliently curved configuration convexedly disposed toward and extending toward the other of said first and second contact regions;

(g) alignment structure defined on said plug barrel and said receptacle for mutual engagement for facilitating engagement of said plug barrel in said receptacle cavity only when said first and second contact regions are mutually aligned for establishing electrical contact between said first and second conductive elements when said plug barrel is inserted into said cavity.

15. The apparatus of claim 14, wherein:

said conductive elements each comprise a portion of strip material containing highly electrically conductive metal.

16. An electrical connector apparatus comprising:

(a) an elongated plug defining an outer wall and made of a material having a low electrical conductivity;
(b) a receptacle made of a material having low electrical conductivity, said receptacle having a wall defined by inward and outward facing surfaces, said inward facing surface defining a receptacle cavity for accommodating said plug therein;
(c) a first conductive element attached to and extending generally longitudinally with respect to said plug, said first element defining a first contact region exposed facing outwardly from near said outer wall of said plug;
(d) a second conductive element attached to and extending generally longitudinally with respect to said receptacle and defining a second contact region facing inwardly into said cavity, said first and second contact regions being engageable in electrical conductive contact when said plug is engaged in said receptacle with said first contact region and said second contact region being aligned, and
(e) an auxiliary contact element extending about at least a portion of the outer perimeter of said plug.

17. An electrical connector apparatus comprising:
(a) an electrical plug defining an outer wall and made of a material having low electrical conductivity;
(b) a receptacle made of a material having low electrical conductivity, said receptacle having a wall defined by inward and outward facing surfaces, said inward facing surface defining a receptacle cavity for accommodating said plug therein;
(c) a first conductive element attached to and extending generally longitudinally with respect to said plug, said first element defining a first contact region exposed facing outwardly from near said outer wall of said plug;
(d) a second conductive element attached to and extending generally longitudinally with respect to said receptacle and defining a second contact region facing inwardly into said cavity, said first and second contact regions being engageable in electrical conductive contact when said plug is engaged in said receptacle with said first contact region and said second contact region being aligned.

18. The apparatus of claim 17, wherein:
said plug and receptacle are each made principally of composite material.

19. The apparatus of claim 17, further comprising:
(a) at least one key defined on the outer wall of said plug, and
(b) at least one keyway defined on said inwardly facing surface of said receptacle, said keyway being sufficiently large to accommodate placement therein of a portion of said second conductive element.

20. The apparatus of claim 17, wherein:
(a) said receptacle defines a flange extending outwardly from said outward facing wall of said receptacle, and
(b) said second conductive element extends through said receptacle wall and around said flange defining an electrically conductive path around said flange.

21. Apparatus for electrically coupling together adjacent ends of jacketed electrical cable including at least one internal electrical connector and an at least partially electrically conductive outer jacket, said apparatus comprising:
(a) an electrical plug defining an outer wall and made of a material having a low electrical conductivity;
(b) a receptacle made of a material having low electrical conductivity, said receptacle having a wall defined by inward and outward facing surfaces, said inward facing surface defining a receptacle cavity for accommodating said plug therein;
(c) said plug and receptacle comprising means adapted for electrically conductive coupling to said at least one internal conductor of each said adjacent end of said jacketed cable and for electrically conductively coupling together said internal conductor ends;
(d) a first conductive element attached to and extending generally longitudinally with respect to said plug, said first element defining a first contact region exposed facing outwardly from near said outer wall of said plug, said first conductive element being adapted for electrically conductive connection to one adjacent end of said outer jacket;
(e) a second conductive element attached to and extending generally longitudinally with respect to said receptacle and defining a second contact region facing inwardly into said cavity, said second conductive element being adapted for electrically conductive connection to the other adjacent end of said outer jacket of said cable, said first and second contact regions being engageable in electrically conductive contact when said plug is engaged in said receptacle with said first contact region and said second contact region being aligned.

22. An electrical connector apparatus for coupling together adjacent ends of jacketed electrical cable, the cable including at least one inner electrical conductor and an at least partially electrically conductive outer jacket, said apparatus comprising:
(a) an electrical plug defining an outer wall and made of a material having low electrical conductivity;
(b) a receptacle made of a material having low electrical conductivity, said receptacle having a wall defined by inward and outward facing surfaces, said inward facing surface defining a receptacle cavity for accommodating said plug therein, said plug and receptacle including means for coupling together adjacent ends of said internal electrical conductor;
(c) a first conductive element attached to and extending generally longitudinally with respect to said plug, said first conductive element defining a first contact region exposed facing outwardly from near said outer wall of said plug, said first conductive element including means for facilitating electrical coupling with said outer jacket of one of said adjacent cable ends;
(d) a second conductive element attached to and extending generally longitudinally with respect to said receptacle and defining a second contact region facing inwardly into said cavity, said second conductive element including means for facilitating electrical coupling with said outer jacket of the other of said adjacent cable ends, said first and second contact regions being engageable in electrical conductive contact with one another when said plug is engaged in said receptacle with said first contact region and said second contact region being aligned.

23. An electrical connector apparatus comprising:

(a) an electrical plug defining an outer wall and made of a material having low electrical conductivity;

(b) a receptacle made of a material having low electrical conductivity, said receptacle having a wall defining inward and outward facing surfaces, said inward facing surface defining a receptacle cavity for accommodating said plug therein;

(c) a first conductive element attached to and extending generally longitudinally with respect to said plug, said first element defining a first contact region exposed facing outwardly from near said outer wall of said plug;

(d) a second conductive element attached to and extending generally longitudinally with respect to said receptacle and defining a second contact region facing inwardly into said cavity, said first and second contact regions being engageable in electrical conductive contact when said plug is engaged in said receptacle with said first contact region and said second contact region being aligned;

(e) a first portion of jacketed electrical cable having an at least partially conductive outer jacket and at least one inner conductor and conductive means electrically coupling said first conductive element with said outer jacket of said first portion of electrical cable, and (f) a second portion of jacketed electrical cable having at least one inner conductor and an at least partially electrically conductive outer jacket, said outer jacket of said second portion being electrically coupled to said second conductive element.

* * * * *